United States Patent [19]

Allen et al.

[11] 4,042,027

[45] Aug. 16, 1977

[54] RECOVERY OF PETROLEUM FROM VISCOUS ASPHALTIC PETROLEUM CONTAINING FORMATIONS INCLUDING TAR SAND DEPOSITS

[75] Inventors: Joseph C. Allen, Bellaire; Charles D. Woodward, Houston, both of Tex.

[73] Assignee: Texaco Inc., New York, N.Y.

[21] Appl. No.: 482,044

[22] Filed: June 24, 1974

Related U.S. Application Data

[63] Continuation-in-part of Ser. No. 344,302, March 23, 1973, abandoned.

[51] Int. Cl.[2] ..... E21B 43/24

[52] U.S. Cl. ..... 166/260; 166/261

[58] Field of Search ..... 166/256–262, 166/270, 272, 288, 300, 305 R

[56] References Cited

U.S. PATENT DOCUMENTS

| | | | |
|---|---|---|---|
| 2,788,071 | 4/1957 | Pelzer | 166/260 |
| 2,876,840 | 3/1959 | Berry | 166/305 R |
| 2,914,309 | 11/1959 | Salomonsson | 166/288 |
| 3,062,282 | 11/1962 | Schleicher | 166/256 |
| 3,093,191 | 6/1963 | Glass | 166/261 |
| 3,167,121 | 1/1965 | Sharp | 166/261 |
| 3,196,945 | 7/1965 | Craig et al. | 166/261 |
| 3,285,336 | 11/1966 | Gardner | 166/260 |
| 3,314,477 | 4/1967 | Boevers et al. | 166/260 |
| 3,542,129 | 11/1970 | Bauer | 166/261 |
| 3,587,739 | 6/1971 | Parker | 166/261 |

*Primary Examiner*—Ernest R. Purser

*Attorney, Agent, or Firm*—Thomas H. Whaley; Carl G. Ries; Jack H. Park

[57] ABSTRACT

Petroleum materials may be effectively recovered from subterranean, viscous, asphaltic or bituminous formations such as tar sand deposits by first injecting into the tar sand formation a paraffinic hydrocarbon at a temperature below 300° F which precipitates asphaltic material from the asphaltic petroleum in the formation. Next, solvent injection is terminated and air is injected into the formation, and the formation is ignited to accomplish in situ combustion within the tar sand reservoir utilizing the precipitated asphaltic materials for fuel for the in situ combustion reaction. Reaction temperatures higher than normal in situ combustion temperatures are produced, facilitating thermal cracking and in situ hydrogenation to up grade the produced crude within the tar sand reservoir.

18 Claims, No Drawings

RECOVERY OF PETROLEUM FROM VISCOUS ASPHALTIC PETROLEUM CONTAINING FORMATIONS INCLUDING TAR SAND DEPOSITS

CROSS REFERENCE TO RELATED APPLICATION

This application is a continuation-in-part of our copending application Ser. No. 344,302, filed Mar. 23, 1973 and now abandoned.

BACKGROUND OF THE INVENTION

FIELD OF THE INVENTION

This invention concerns a method for recovering petroleum from viscous, asphaltic petroleum containing formations such as tar sand deposits utilizing a combined in situ solvent deasphalting process with in situ combustion.

2. DESCRIPTION OF THE PRIOR ART

There are known to exist in many locations throughout the world, large deposits of viscous, asphaltic petroleum containing formation. The most famous such formations are the tar sands, also known as oil sands, or bituminous sands. The largest and most famous deposit is located in the Athabasca area in the Northeastern part of the Providence of Alberta, Canada, which has been estimated in the literature to contain over 700 billion barrels of petroleum. Other large tar sand deposits are found in the United States and Venezuela, and smaller deposits are located in Europe and Asia.

Tar sand deposits differ from conventional petroleum reservoirs in a number of respects. The hydrocarbon portion is highly bituminous in character, and is much more viscous than conventional petroleum. The deposits contain sand, predominately fine quartz sand, which is covered with a film of water. Surrounding the wetted sand grains and essentially filling the void volume among them is a film of bituminous hydrocarbon. The balance of the void volume may be filled with connate water, and sometimes small quantities of gas are encountered, which is usually air or methane. The sand grain represent about 65% by volume of the total volume of the deposit, which is equivalent to about 85% by weight. The sum of the bitumen and water concentration will generally equal about 17%, with the bitumen portion thereof varying from about 3% to about 15% by weight. The most unique difference between the tar sand deposit and conventional petroleum reservoirs is the fact that in the best developed tar sands intervals the bitumen is in fact the continuous phase of the reservoir, and the sand grains are suspended in the bitumen.

The bitumen properties vary throughout the world, although they are fairly constant in broad geographic areas. For example, the bitumen characteristics of the United States tar sand deposits are fairly consistently the same. The density of the bitumen is generally slightly greater than the density of water at 60° F. About 50% of the bitumen is distillable without cracking. The sulfur content of the bitumen varies from 4.5 to 5%. Thus it can be appreciated that considerable on site processing must be undertaken in order to transport and utilize the hydrocarbons contained from tar sand deposits.

There are two basic approaches for recovering the hydrocarbon or bituminous material from tar sand deposits. The tar sands may be mined and transported to a processing plant where the bitumen is extracted and the sand is discharged, or the separation of bitumen from sand may be accomplished within the reservoir by an in situ process. In situ recovery processes are closely related to so-called supplemental recovery or secondary recovery of crude oils from conventional oil reservoirs, although there are differences imposed by the unique characteristics of tar sand deposits.

The in situ processes for recovering bitumen from tar sand deposits may generally be classified as:

1. Thermal methods, including fire flooding also known as in situ combustion, and steam injection, and 2. Emulsion steam processes in which an emulsifier is injected into the formation via a previously created fluid communication path, and steam is injected to partially liquify the bitumen and to form an oil in water emulsion in order to create a fluid having suitable flow properties for recovery from the subterranean deposit.

In in situ combustion or fire flooding, heat for viscosity reduction is generated within the formation by injecting air into the formation and igniting the formations so as to produce a combustion reaction within the tar sand deposit itself. Some of the hydrocarbons are consumed in the in situ combustion reaction, but a substantial proportion of the hydrocarbons are recovered.

In U.S. Pat. No. 3,062,282, A. R. Schlercher, Nov. 6, 1962, there is disclosed an in situ combustion type of oil recovery process wherein a flushing fluid such as air or normally gaseous, paraffinic hydrocarbons such as propane, is injected into a formation preheated to a temperature of at least 300° F, to displace heavy liquid hydrocarbons therefrom, followed by in situ combustion.

If it is desired to apply in situ combustion techniques to formations containing very viscous hydrospecifically tar sand deposits, it is often impossible to raise the reaction temperature high enough to achieve the desired mobility of the fluid by thermal means alone. It is recognized in the prior art that come in situ thermal cracking of the hydrocarbon materials may be accomplished if the temperatures can be raised to a sufficiently high level. In conventional oil reservoirs it is possible to operate under conditions so as to achieve a limited degree of thermal cracking by increasing the air injection pressure so as to increase the temperature of the combustion reaction. This is usually not possible in tar sand deposits, since a great many of these deposits are generally relatively shallow, e.g. in order of 100 to 1,000 feet deep as compared to the more conventional hydrocarbon deposits. If the air injection pressure is raised in shallow deposits, fracturing of the formation results, which is detrimental to oil recovery by in situ combustion. Furthermore, a higher degree of thermal cracking must be accomplished in tar sand deposits in order to achieve a fluid mobility sufficient to permits recovery.

Thus it can be seen that there is a substantial unfulfilled need for a method for performing in situ combustion in tar sand deposits in such a way that a relatively high combustion temperature is obtained, so that appreciable thermal cracking of the bituminous hydrocarbon materials occurs.

Most tar sand deposits contain hydrocarbon materials which are a mixture of high molecular weight bituminous materials and more conventional lower molecular petroleum components. Since the bituminous materials require surface treating to render them sufficiently mobile for pipeline transportion to remotely located refineries, the more mobile conventional petroleum materials have a higher dollar value. Accordingly, if any of the hydrocarbon material present in tar sands must be consumed by the in situ combustion reaction, it would be highly desirable to utilize a larger percentage of less valuable, less mobile bituminous materials as the fuel for the in situa combustion reaction. Accordingly, there is also a substantial need for a method for conducting in situ combustion oil recovery under conditions which preferentially consume the high molecular weight bituminous materials as fuel for the in situ combustion reaction.

SUMMARY OF THE INVENTION

We have discovered, and this constitutes our invention, that hydrocarbons may be recovered from tar sand deposits by first injecting into the tar sand deposit a low molecular weight paraffinic material such as propane at a temperature below 300° F and preferably below 150° F, which solubilizes the non-asphaltic materials present in the tar sand, and causes precipitation of the asphaltic materials on the sand grains in the tar sand deposit. After the quantity of asphalt precipitating solvent is injected, air injection is initiated in the tar sand deposit and the formation is ignited by conventional means to cause the propagation of an in situ combustion reaction front thru the reservoir. The precipitated asphaltic materials is the fuel for the in situ combustion reaction, driving the more volatile materials ahead of the combustion front. Air injection may be continued thereafter until the reservoir has been completely depleted, or it may be followed after a period of time by the injection of a less expensive drive fluid such as water into the burned out portion of the reservoir.

DESCRIPTION OF THE PREFERRED EMBODIMENTS

Generally our invention pertains to a novel method for recovering hydrocarbons from a subterranean reservoir which contains hydrocarbons having abnormally high content of asphaltic materials. The petroleum should contain at least 5% and preferably 10% or more asphalt. This method is especially applicable to tar sand or bitumen sand reservoirs, but may be applied to any oil reservoir containing hydrocarbons with a high content of asphaltic materials. It is an especially attractive feature of our invention that the asphaltic material present in the formation hydrocarbon fluid is selectively utilized as the fuel for the in situ combustion reaction which accomplishes the enhanced oil recovery. Since the asphaltic materials are the least desirable and least valuable of the hydrocarbon fluids, the economics of the oil recovery process are especially enhanced by the selective utilization of asphaltic materials as the fuel for in situ combustion. Furthermore, the precipitation of the asphaltic materials by the injected solvent in the first step of our process insures that a high fuel density will be available for the ensuing in situ combustion phase. The presence of a high fuel density will provide a high reaction temperature in the reservoir, which will accomplish a considerable degree of thermal cracking and in situ hydrogenation so that the viscosity of the produced fluid is reduced in situ in the reservoir. The thermal cracking and in situ hydrogenation operations aid in the improved oil recovery, and also increases the value of the crude produced on the surface.

In a typical embodiment of our invention a solvent which also affects asphaltic material precipitation is injected into the reservoir. The solvent may be any aliphatic hydrocarbon solvent preferably a paraffinic hydrocarbon having from 2 to 6 carbon atoms, and the especially preferred solvent is propane, $C_3H_8$. The solvent utilized in the first phase of our procedure represent a dramatic variation over what would normally be good procedure for miscible flooding operations in much reservoirs. Ordinarily, if one desired to operate a miscible flood recovery operation, the solvent would be carefully chosen so as not to cause precipitation of asphaltic materials. In those processes described in the literature which involve injecting light paraffinic hydrocarbons such as propane, either the formation is preheated, or both, in order to avoid precipitation of asphalt. We have discovered however, that the precipitation can be an advantage when used as a first phase of a multiple step operation wherein the solvent is followed by injection of air, and ignition of the formation to achieve in situ combustion. Furthermore, it is not necessary to inject the same quantity of solvent as would be required in the instance of a conventional miscible placement procedure. Ordinarily, from about 0.5 to about 1.0 are preferably from 0.1 to 0.5 solvent will be adequate to affect the required degree of asphaltic material precipitation necessary to achieve the benefits of our invention.

Since the solubility of the asphaltic materials in the aliphatic hydrocarbon solvent increases with temperature, the desired asphalt precipitation step is accomplished only if the solvent is not heated. The paraffinic hydrocarbon must be injected into the formation below about 300° F, and preferably below 150° F. Ideally, the material should be injected under conditions such that it exist in the formation as a liquid at the injection conditions of temperature and pressure. In shallow formations, which impose an injection pressure restrictions, it may be necessary to cool the solvent prior to injection in order to ensure that the material will exist as a liquid in the petroleum formation so as to accomplish the desired asphaltic precipitation prior to initiating air injection for in situ combustion. This cooling step is frequently necessary even if ambient temperatures are low because the compression of solvent for injection raises the temperature well above ambient temperatures.

After solvent injection has been completed, air is injected into the formation and sufficient heat is applied to the injection well bore to initiate a combustion reaction within the formation. The in situ combustion phase of our operation will be accomplished in essentially the same manner as any conventional fire flooding secondary recovery operation. Ordinarily the preferred embodiment will involve the compression of air on the surface and injection of the compressed air into the formation, although any oxygen containing gas or pure oxygen may be used. The pressure will ordinarily be limited by the overburden thickness, since injection of high pressure air into a relatively shallow formation will cause fracturing of the formation, with channeling of the air through the formation without efficient displacement of oil. Many of the tar sand deposits in which our invention will be especially applicable are relatively shallow. For example, if the overburden thickness is around 300 feet, the air pressure must be held below about 300 pounds per square inch in order to avoid the undesirable fracturing of the formation. The air injection rate will be limited by the injectivity of the formation itself, and air should be injected at about the maximum rate it can be injected without exceeding the overburden related pressure limitation described above. Ordinarily the injectivity will increase as the combustion front moves away from the well bore, and so the air rate will increase with time as the in situ combustion phase of our recovery method procedes.

In order to achieve the maximum benefit possible from the application of our process to a tar sand deposit, it is essential that the combustion reaction temperature be raised to as high a level as possible. Thermal cracking of bitumen such as occurs in tar sand deposits will not begin until the reaction temperatures in the formation exceeds about 500° F. Thermal cracking will produce some viscosity reduction of the bitumen, but the magnitude of the reduction will not be as great as is possible if the temperature can be raised sufficiently to achieve in situ hydrogenation. If the temperature can be raised to about 1,300° F, steam reforming will occur, and hydrogen will generated in situ which will provide spontaneous hydrogenation of the bitumen in place in the reservoir. Hydrogenation can effect a greater viscosity reduction than is possible with thermal cracking, and the production rate and recovery efficiency will be improved dramatically.

In order to achieve the high reaction temperatures necessary to accomplish steam reforming to generate hydrogen and in situ hydrogenation of crude to bring about the desired viscosity reduction, either the air injection rate and pressure must be increased considerably over the pressure and flow rates discussed above, or else the fuel utilized in the combustion reaction must be modified in some manner. Since the relatively shallow tar sand deposits cannot be subjected to high injection air pressures, the only possible way of achieving high reaction temperatures is by modification of the fuel utilized in the reaction process. This is one reason for the preliminary step of our process, wherein propane or other light paraffinic hydrocarbon is injected for the purpose of accomplishing asphalt precipitaion. The asphalt deposits on the sand particles and as portions of the formation ahead of the combustion front are heated by combustion gases from the in situ combustion reaction front, the high molecular weight asphaltic materials will yield and lay down on the solid surfaces much more fuel in the form of a coke-like material for burning than would be provided by the whole crude. Thus, it is possible by following the procedures of our invention to operate a high temperature in situ combustion operation in a tar sand deposit which is too shallow to permit high pressure air injection to achieve the high temperatures necessary to accomplish thermal cracking and in situ hydrogenation.

Once air injection into the formation is initiated, some step must be taken to ignite the deposited asphaltic materials so as to initiate the in situ combustion reaction. There are many needs available in the Art for accomplishing this, for example, the spontaneous chemical method described in U.S. Pat. No. 3,180,412 may be used effectively. Also, there are gas-fired or electric heating devices which may be inserted into the air injection well bore to raise the temperature of the formation adjacent to the well bore to a temperature of at least 300° F., which will be sufficient to initiate the desired combustion reaction. Once the deposited asphaltic material is ignited, the combustion fron is self sustaining, and no additional extraneous heat need be supplied to the formation. Once it is determined by temperature measurements that ignition has been accomplished, the ignition devices are removed from the well bore and air injection is continued. The previously injected propane or other solvent slug will continue to move ahead of the combustion front because of its low volatility, so it will continue to deposit sufficient asphaltic materials to provide the fuel needed to sustain the combustion front.

In situ combustion processes are generally continued until the temperature at the production well begins to increase, indicating that the in situ combustion front is approaching the production well.

A slightly different embodiment of our invention involves termination of air injection after it determined that the in situ combustion front has proceeded some distance away from the injection well, and is, for example, halfway between the injection well and the production well, and injecting water into the formation. There is sufficient air still contained in the formation in advance of the finally injected water that combustion will continue for a period of time, and the desired thermal cracking and steam reforming in situ hydrogenation will continue in conjunction with the combustion front to achieve the desired viscosity reduction of the the bituminous hydrocarbon fluids ahead of the injected water. The water injection will savenge heat from the burned out areas of the formation, and the final phase of oil recovery will be achieved at a reduced cost since the cost of water injection is substantially less than the cost of air injection. In this latter instance the water injection may be continued until water breaks through at the producing well, in which point is necessary to shut in the well since the water/oil ratio will generally rise rather quickly in a short period of time once water breakthrough has occurred.

Alternately, water injection may be initiated with air injection continued. Simultaneous air and water injection continues, with the upper limit of quantity of water injected being the amount just short of quenching the in situ combustion front. Ideally, water injection will be initiated as soon as the combustion front is from 20 to 100 feet away from the injection well. Simultaneous air and water injection will continue for some time, with the air injection being terminated when the oil production rate has declined to a stable low value or when the production well temperature increases. Water injection continues until the water cut rises to a high value, usually about 95%.

Another attractive embodiment of our process especially as applied to large fields, involves conversion of producing wells to injection wells after the water cut has reached about 95%. Air and water injection may be continued into the converted well with the combustion front being propagated without having been extinguished into a a new pattern.

The process of our invention is better understood by reference to the following field example, which is offered only for purpose for illustration of a preferred embodiment and is not intended to be limitative or restrictive of our invention.

FIELD EXAMPLE

A tar sand deposit is discovered at a depth of 350 feet, and it is determined that the thickness of the tar sand deposit is 60 feet. Production wells are drilled on a square grid pattern approximately 400 feet apart, and injection wells are drilled in center of each square grid pattern. It is determined that the bituminous petroleum saturation of the tar sand deposit is relatively high, but the viscosity of the petroleum is too high to recover any part thereof by conventional production means. That is to say, the bituminous petroleum is essentially immobile at reservoir conditions, and some treatment to reduce the viscosity of the petroleum must be undertaken in order to recover any part thereof.

It is determined that the permeability of the tar sand deposit averages about 30%, and so the total pore volume in each square grid pattern will be 0.30 × 400 × 400 × 60 = 2,880,000 cubic feet. Since the sweep efficiency of a pattern such as described above is 70%, the total swept area will be 0.7 × 2,880,000 or 2,016,000 cubic feet.

It is determined that a relatively impure propane is available for low cost in the field, which is determined to be 85% propane, 5% ethane and 10% butane. This material is satisfactory as the asphalt precipitation solvent, and 0.5 pore volumes of 1,440,000 cubic feet (10.8 million gallons) of this material is cooled to a temperature of 50° F and injected into each injection well. Cooling is desired to ensure that the propane is essentially all liquid in the formation. Care is taken to avoid exceeding approximately 350 pounds per square inch injection pressure, since it is desired to accomplish injection of the solvent into the tar sand deposit without causing a fracture to occur, which would interfere with efficiency sweep of the formation. Injection of the solvent is completed in approximately 500 days.

After completion of solvent injection, air compressors are placed in operation and air is injected into the injection well at the maximum rate possible without exceeding 350 pounds per square inch. After air injection for approximately 24 hours, the well bore is subjected to heating by a 100 KW electric heater to initiate the combustion reaction. Since the injection well bore is perforated essentially the entire thickness of the tar sand interval, a relatively long heating element is positioned adjacent to these performations so that air entering the perforations is heated to a temperature approximately 500° F., which is sufficient to heat the formation so as to initiate the combustion reaction. It is only necessary to heat the formation utilizing this electric heater for approximately 36 hours in order to initiate a stable combustion reaction within the formation, which can thereafter be propagated without additional extraneous heat being supplied to the formation. The electric heater is then removed from the injection well bore, and air injection is continued without interruptions.

After air injection has been continued for approximately 600 days, calculations indicate that slightly more than half of the volume to be swept by the injected fluid should have been contacted by the injected air. Air injection is then terminated, and water injection is initiated to sweep the burned out area of the tar sand deposit, scavenging heat therefrom and pushing the previously injected air the rest of the way through the formation. The production well bore temperature beings to increase after approximately 800 days, and the water/oil ratio also increases indicating the approach of the injected water. The produced water is utilized for a period as injection water, but after the water/oil ratio exceeds about 30, the water injection of the operation is terminated.

The foregoing field example demonstrates the method for employing our invention, but it will be obvious to persons skilled in the art oil recovery that many variations are possible without departing from the true spirit and scope of our invention. Similarly, while a reaction has been proposed to describe the benefits resulting from applicaion of our process, it is not necessarily represented hereby that this is the only or even the principal reaction occurring and responsible for the beneficial results achieved through the practice of the process of our invention.

We claim:

1. A method for recovering petroleum from a subterranean, porous, permeable formation containing petroleum having a high asphaltic content including tar sand deposits, penetrated by at least one injection well and at least one production well comprising:

a. cooling a low molecular weight paraffinic hydrocarbon solvent having from 2 to 6 carbon atoms to a temperature less than 150° F.;

b. injecting said low molecular weight hydrocarbon into the formation at a pressure at which the hydrocarbon solvent is entirely in the liquid phase into the portion of the formation adjacent the injection well, to precipitate asphaltic materials from the formation petroleum present in the portion of the formation adjacent to the injection well on the sand grains in the portion of the formation adjacent to the injection well;

c. thereafter injecting air into the formation following the solvent injection, and d. igniting a portion of the formation adjacentthe injection well to initiate an in situ combustion reaction in the portion of the formation contacted by said solvent, said in situ combustion reaction utilizing the precipitated asphaltic material as fuel; and e. recovering petroleum from the formation via the production well.

2. A method as recited in claim 1 wherein the low molecular weight paraffinic solvent is selected from the group consisting of ethane, propane, butane, pentane, hexane and mixture thereof.

3. A method as recited in claim 2 wherein the low molecular weight paraffinic solvent is propane.

4. A method as recited in claim 2 wherein the low molecular weight paraffinic solvent is butane.

5. A method as recited in claim 1 wherein the low molecular weight paraffinic solvent is liquefied petroleum gas.

6. A method as recited in claim 1 wherein from about 0.1 to about 1.0 pore volumes of the low molecular weight paraffinic solvent is injected into the formation.

7. A method as recited in claim 1 wherein ignition of the formation to initiate the in situ combustion reaction is accomplished by locating an electric heater in the injection well.

8. A method as recited in claim 1 wherein the ignition of the formation to initiate the in situ combustion reaction is accomplished by locating a gas heating device in the injection well.

9. A method as recited in claim 1 wherein ignition of the formation to initiate the in situ combustion reaction is accomplished by injecting spontaneous igniting chemicals into the formation.

10. A method as recited in claim 1 comprising the addition steps of stopping heating the formation after ignition of the formation has occurred and continuing injecting air into the formation for in situ combustion.

11. A method as recited in claim 1 comprising the additional step of injecting water into the wellbore simultaneously with air injection after the in situ combustion front has moved at least 20 feet away from the injection well.

12. A method as recited in claim 1 comprising the additional step of injecting water into the injection well after termination of air injection.

13. A method as recited in claim 1 comprising the additonal step of converting the producing well into an injection well after the water-oil ratio of the fluid being produced has risen to a predetermined value.

14. A method as recited in claim 1 comprising the additional step of converting the producing well into an injection well after the temperature of the produced fluid has risen to a predetermined value.

15. A method as recited in claim 1 wherein the solvent is cooled to a temperature below surface ambient temperature.

16. A method as recited in claim 1 wherein the solvent is cooled to at least a temperature sufficient to ensure that the solvent well enter the formation as a liquid.

17. A method as recited in claim 1 wherein air is injected into the formation following solvent injection for a preselected period before the formation petroleum is ignited.

18. A method as recited in claim 17 wherein air is injected for at least 24 hours before the formation petroleum is ignited.

* * * * *